US005981856A

United States Patent [19]

Story

[11] Patent Number: 5,981,856

[45] Date of Patent: Nov. 9, 1999

[54] SLIDE SYSTEM FOR A STRINGED MUSICAL INSTRUMENT

[76] Inventor: Brooks J. Story, 6711 Xana Way, Carlsbad, Calif. 92009

[21] Appl. No.: 08/910,077

[22] Filed: Aug. 12, 1997

[51] Int. Cl.[6] ..... G10D 3/00

[52] U.S. Cl. ..... 84/319

[58] Field of Search ..... 84/319

[56] References Cited

U.S. PATENT DOCUMENTS

D. 360,647 7/1995 Jimenez .
3,638,525 2/1972 Sciurba et al. .
3,854,368 12/1974 Pogan .
4,817,488 4/1989 de los Santos .
5,488,891 2/1996 Baker .
5,492,046 2/1996 Jimenez .

*Primary Examiner*—Jeffrey W. Donels
*Attorney, Agent, or Firm*—Gregory Garmong

[57] ABSTRACT

A stringed-instrument slide system includes a cylindrical finger ring having an inner diameter sized to be received on a finger of a human hand, and a slide sleeve rotatably engaged to the finger ring. The slide sleeve includes a cylindrical slide sleeve base overlying the finger ring, a semicylindrical slide sleeve body affixed to the slide sleeve base, and a rotational engagement between the slide sleeve and the finger ring.

13 Claims, 5 Drawing Sheets

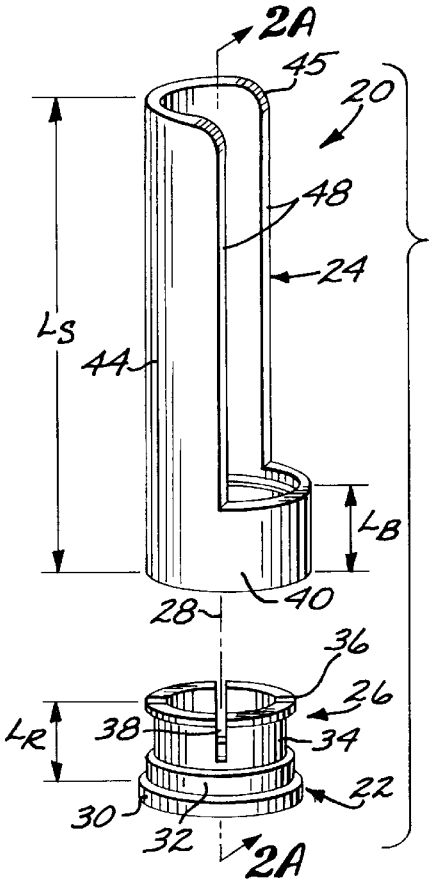
FIG.1A
FIG.1B
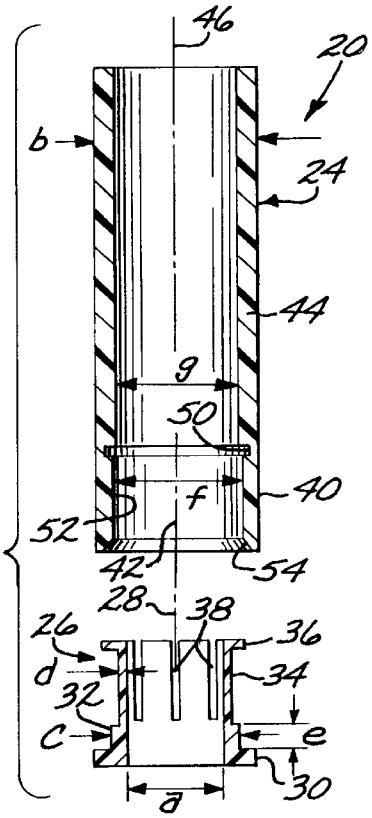
FIG.2A
FIG.2B
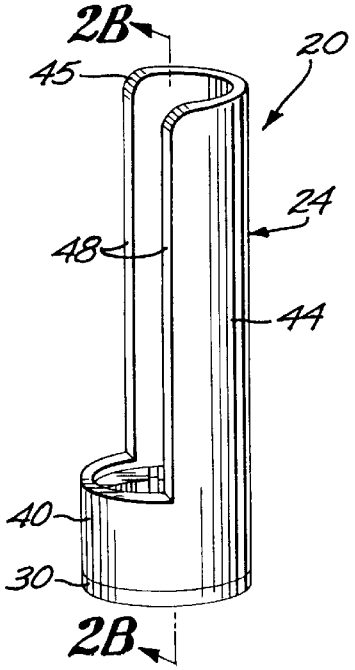
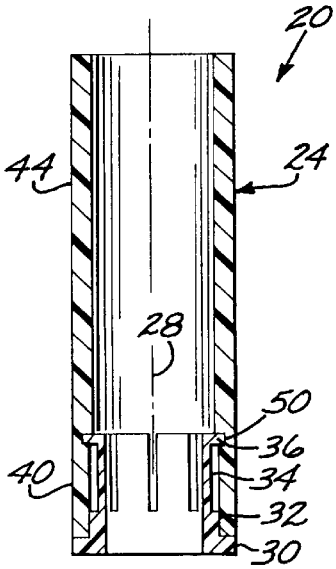

SLIDE SYSTEM FOR A STRINGED MUSICAL INSTRUMENT

BACKGROUND OF THE INVENTION

This invention relates to stringed musical instruments, and, more particularly, to a slide system worn on the fretting hand of the player of a guitar.

In conventional guitar playing, the player holds the guitar and uses the picking hand to pluck or strum the strings and the fretting hand to press appropriate strings against the frets of the instrument to raise or lower their pitch. Alternatively, the player may use the slide hand (which otherwise would be the fretting hand) to contact a solid object to the strings to modify their pitch, instead of pressing the strings against the frets. The solid object, known as a "slide", generally has the effect of a movable fret whose position along the length of the string determines the pitch of the string, but there are important differences. The slide allows a continuous range of sounds to be produced from each string, rather than the fixed sounds obtained when only a fret is used.

Various types of slides which are worn on the slide hand have been developed. These slides usually take the form of a ring or other structure that is worn on one finger of the slide hand, with a projection from the ring which is controllably contacted to the strings to perform the slide function. In a basic form, the slide projection is simply a tube, but this version prevents the player from playing in the conventional manner unless the player stops to remove the slide projection from the finger. More advanced slide implements, which allow the uninterrupted alternating use of the slide and conventional playing, are disclosed in, for example, U.S. Pat. Nos. 3,638,525; 3,854,368; 4,817,488; and 5,492,046, whose disclosures are incorporated by reference. In some approaches, the slide is relatively stationary on the hand of the player. In others, as shown in FIGS. 11–16 of the '046 patent, the slide implement may be rotated to different positions around the circumference of the finger to permit the slide implement to be used in various ways or moved out of the way and not used, depending upon the playing requirements of the moment.

While the slides described in the referenced patents and available commercially are operable to various degrees, they all are rather inconvenient to use. The tab 40 found on the slide of the '046 patent aids in rotating the slide implement, but it is somewhat awkward to use during actual playing of the instrument and requires the use of a second finger to effect rotation. Other slides require the use of two fingers to support and stabilize the slide, also reducing the number of fingers available to perform other functions such as damping of the strings.

There is, accordingly, a need for an improved approach to the structure and use of a slide employed in the playing of a stringed instrument. The present invention fulfills this need, and further provides related advantages.

SUMMARY OF THE INVENTION

The present invention provides a slide system for use in playing a stringed instrument. The slide system is worn on one finger of the slide hand of the player. It includes a slide to contact the strings. The slide may be easily moved into position for use and out of position, when it is not to be used, by a simple, natural movement of the hand. The only finger used to operate the movable slide is the finger upon which it is worn. Movement of the slide in and out of the use position is quickly effected with the thumb of the slide hand, with minimal interruption to the playing and only involving a slight movement of the hand, and without using the other hand at all. The three fingers of the slide hand normally used for string damping remain available to perform this function.

In accordance with the invention, a stringed-instrument slide system comprises a cylindrical finger ring having an inner diameter sized to be received on a finger of a human hand and having a cylindrical finger ring axis. The slide system further includes a slide sleeve comprising a cylindrical slide sleeve base having a base axis coincident with the ring axis, and a slide sleeve body extending from the slide sleeve base in a direction generally parallel to the base axis. The slide sleeve body is in the form of a tube having an opening therethrough extending generally parallel to the base axis. There is means for engaging the slide sleeve to the finger ring and for permitting the slide sleeve to rotate about the cylindrical finger ring axis. The means for engaging preferably includes a first cylindrical track extending generally circumferentially around an exterior of the finger ring, and a second cylindrical track extending generally circumferentially around an interior of the slide sleeve base. The second cylindrical track is slidably engaged to the first cylindrical track to permit the rotational movement of the slide sleeve about the finger ring. The detailed structure of the bushing-like finger ring is selected to provide a bearing surface for the inner surface of the slide sleeve body which allows controllable rotation of the slide sleeve body. Desirably, a frictional engagement is positioned on an exterior surface of the slide sleeve base so that the thumb of the player's slide hand may be used to controllably and accurately move the slide sleeve in the rotational direction. The finger ring and the slide sleeve are preferably produced as two separate elements that are engaged together for playing.

The present approach provides a slide system having a slide that performs the slide function and which is easily moved into and out of the playing position. The finger ring provides a smooth surface around which the slide sleeve body is rotated, preventing the metal-to-skin binding that inhibits the rotational movement of prior slide implements. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIGS. 1A and 1B are perspective views of the slide system of the invention, illustrating a disassembled view (FIG. 1A) and an assembled view (FIG. 1B);

FIGS. 2A and 2B are sectional views of the slide system of the invention, illustrating a disassembled view (FIG. 2A) and an assembled view (FIG. 2B), wherein FIG. 2A is taken generally along lines 2A—2A of FIG. 1A and FIG. 2B is taken generally along lines 2B—2B of FIG. 1B;

DETAILED DESCRIPTION OF THE INVENTION

Figure 3C:
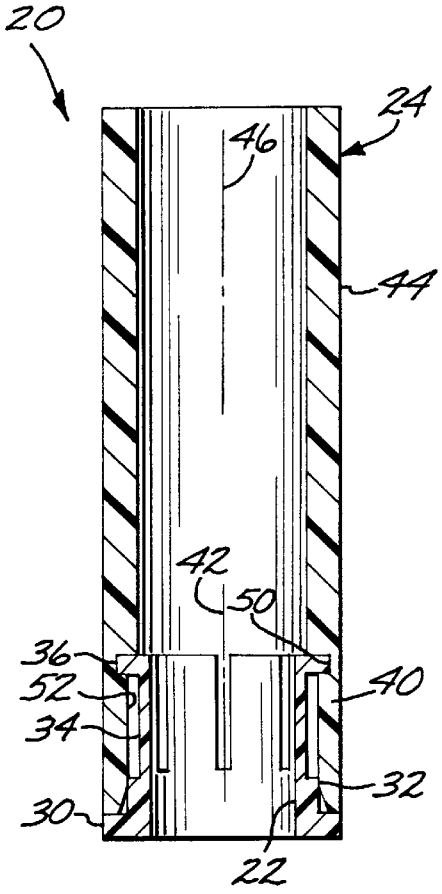
FIGS. 3A–3C are a series of sectional views like those of FIGS. 2A–2B, illustrating the assembly of the slide system, with FIG. 3A illustrating the elements prior to assembly, FIG. 3B illustrating the elements at an intermediate stage of assembly, and FIG. 3C illustrating the elements after assembly is complete.

FIGS. 1 and 2 illustrate a slide system 20 for a stringed instrument (not shown). The slide system includes a cylindrical finger ring 22 and a slide sleeve 24 which is rotationally engaged to the finger ring 22.

The finger ring 22 is generally in the shape of a cylindrical annular bushing 26 of substantially constant cylindrical inner diameter and having a cylindrical finger ring axis 28. The inner diameter of the finger ring 22 is sized to be received on a finger of a human hand. The finger ring 22 has a circumferentially extending flange 30 at a first end, and a circumferentially extending bearing surface 32 of lesser cylindrical outer diameter axially adjacent to the flange 30 along the axis 28. A circumferentially extending relief section 34 of lesser cylindrical outer diameter than the bearing surface 32 is axially adjacent to the bearing surface 32 along the axis 28. A radially enlarged and circumferentially extending lip 36, having a cylindrical outer diameter larger than that of the bearing surface 32, is axially adjacent to the relief section 34 and at a second end of the finger ring 22. In a preferred embodiment, at least one slot 38, and preferably eight slots arranged equidistantly around the circumference of the finger ring 22, extend parallel to the axis 28 through the relief section 34 and the lip 36.

The slide sleeve 24 is generally of a partially cutaway or semicylindrical tubular shape. The slide sleeve 24 includes a cylindrical slide sleeve base 40 having an inner diameter dimensioned to overlie the finger ring 22 and contact the bearing surface 32. The slide sleeve base 40 has a cylindrical base axis 42 which, in the assembled slide system 20, is collinear with the finger ring axis 28. A semicylindrical slide sleeve body 44 is integrally fixed to the slide sleeve base 40 and has a cylindrical body axis 46 that is collinear with the base axis 42. The term "semicylindrical" means that the slide sleeve body 44 is generally cylindrical with a circumferentially extending opening 48 therein parallel to the body axis 46. The opening 48 preferably extends circumferentially around the sleeve body for an angular distance of from about 45 degrees to about 315 degrees, most preferably about 180 degrees, but greater or lesser angular openings will still be operable. The slide sleeve body 44 need not be perfectly cylindrical, and the embodiments of FIGS. 8–10, to be discussed subsequently, are within the scope of the term. The distal end of the slide sleeve body 44, remote from the slide sleeve base 40, may be rounded, as indicated at numeral 45, or it may be squared off or of other form. Rounding of the end as at numeral 45 prevents the other fingers of the slide hand from rubbing against a sharp corner. A circumferentially extending groove 50 is formed on an inner surface 52 of the slide sleeve base 40. The outer cylindrical diameter of the bearing surface 32 is smaller, and preferably only slightly smaller by about 0.001–0.006 inches, most preferably about 0.001–0.002 inches, than the inner cylindrical diameter of the slide sleeve base 40.

Figure 3B:
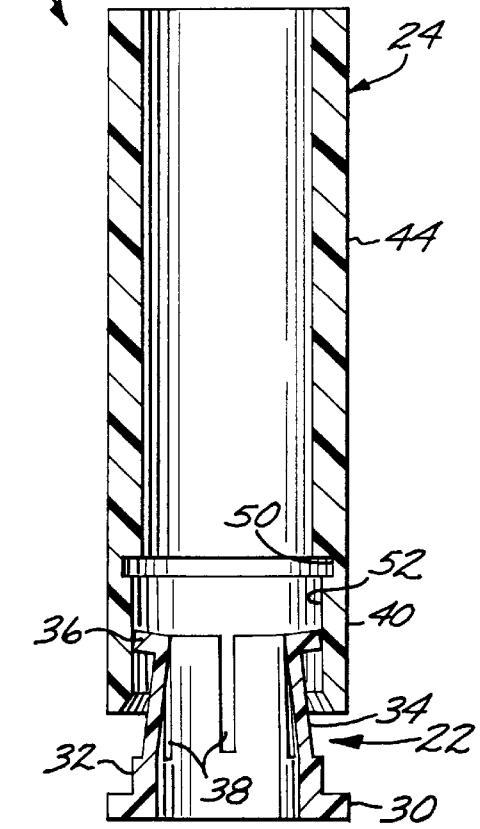
Figure 3A:
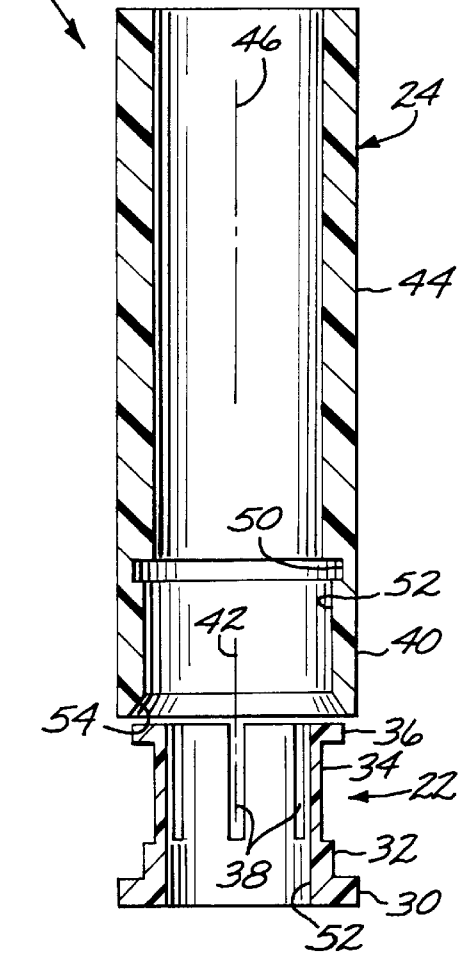

FIGS. 1A and 2A illustrate the slide system 20 prior to assembly, and FIGS. 1B and 2B illustrate the slide system 20 after assembly. FIGS. 3A–3C depict the assembly sequence. The finger ring 22 and slide sleeve 24 are initially disassembled, as shown in FIG. 3A. The second end having the lip 36 is inserted into the slide sleeve base 40, aided by a small chamfer 54 in the end of the slide sleeve base, as shown in FIG. 3B. During insertion, the lip 36 is forced radially inwardly by contact with the inner surface 52 of the slide sleeve base 40, and aided by the presence of the slots 38. At full insertion, FIG. 3C, the lip 36 springs outwardly and is received into the groove 50 on the inner surface 52 of the slide sleeve base 40, locking together the finger ring 22 and the slide sleeve 24. In this preferred embodiment, the locking action is permanent, so that the finger ring 22 may not be later separated from the slide sleeve 24. Alternatively, the finger ring 22 and the slide sleeve 24 may be subsequently separated, as will be discussed for the embodiment of FIG. 6.

The slide sleeve 24 is rotatable in the circumferential direction about the finger ring 22, which is essentially stationary on the finger of the slide hand. In achieving the rotation, the bearing surface 32 and the lip 36 act together as a first rotational track on the outer surface of the finger ring 22. The portion of the inner surface of the slide sleeve base 40 riding on the bearing surface 32 and the groove 50 act together as a second rotational track on the inner surface of the slide sleeve 24.

Figure 4A:
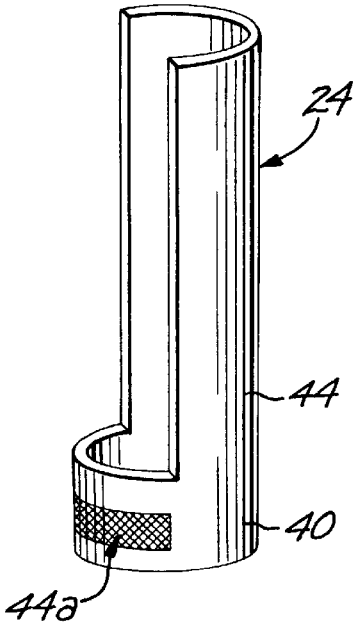
FIGS. 4A and 4B are views of the slide system illustrating two types of frictional engagements.
Figure 4B:
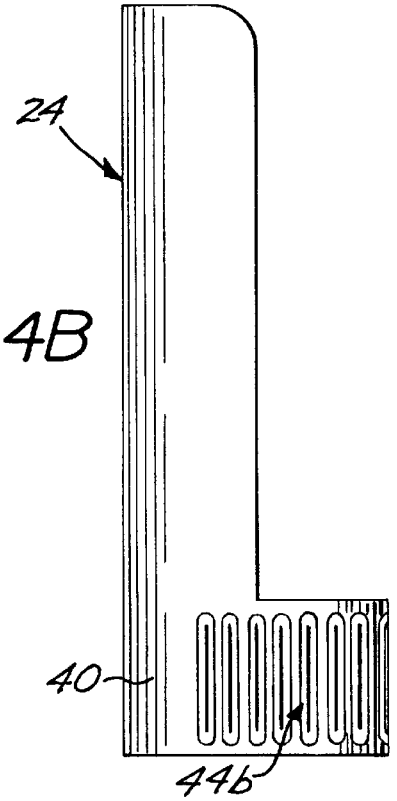

The slide sleeve 24 and finger ring 22 must have sufficient rotational friction therebetween that the slide sleeve 24 stays in place when in use, but may be controllably rotated when desired. To limit the friction, the relief section 34 has a clearance with the inner surface 52 of the slide sleeve base 40, and therefore does not produce any friction. To aid in accomplishing the rotation, a frictional engagement 56 is optionally but preferably provided in the slide sleeve base 40 on the side away from the slide sleeve body 44. Any operable frictional engagement may be employed. Preferably, the frictional engagement extends for about 180° or more around the circumference of the slide sleeve base 40, directly opposite the slide sleeve body 44. FIG. 4A illustrates a first preferred frictional engagement 44*a* formed of a rubber or adhesive strip affixed to the outer surface of the slide sleeve base 40. FIG. 4B illustrates a second preferred frictional engagement 44*b* formed as a series of grooves extending parallel to the base axis 42. The selection of the type of frictional engagement 44 will usually be a matter of personal preference for the player of the instrument.

Figure 5A:
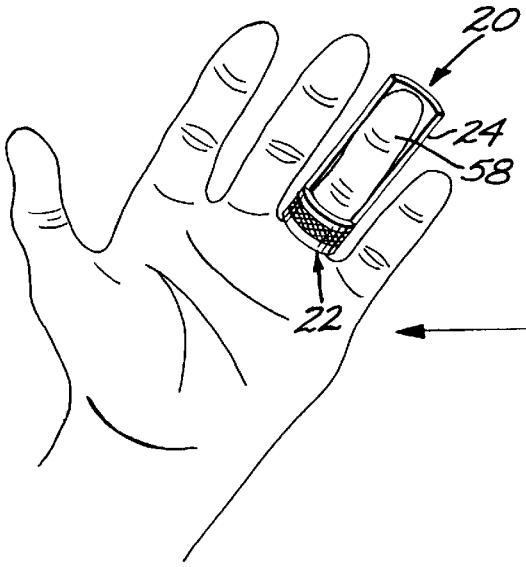
FIGS. 5A–5D are a series of perspective views of the slide system worn on a finger of the slide hand of a player, showing the movements in rotating the slide sleeve.
Figure 5B:
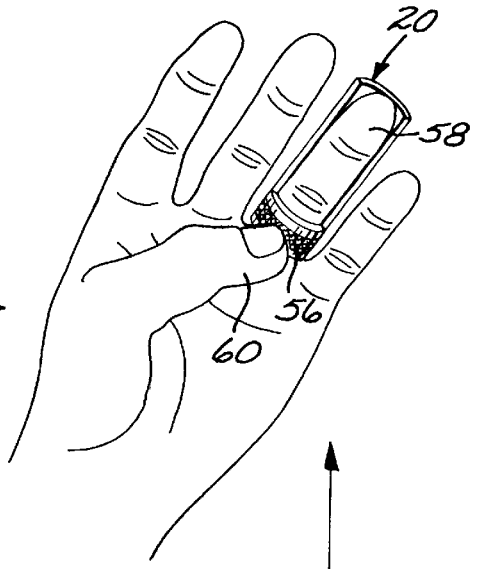
Figure 5D:
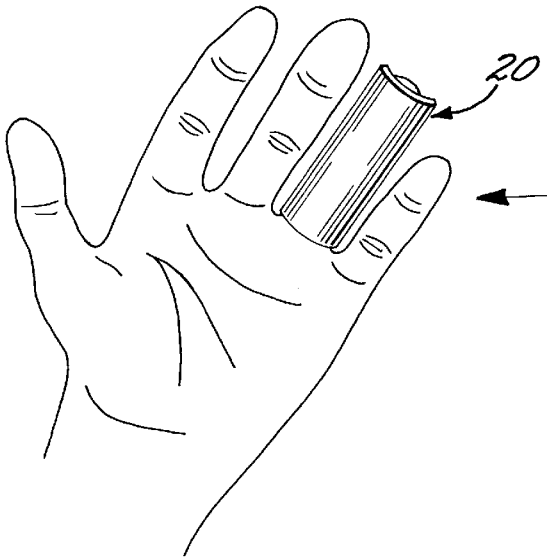
Figure 5C:
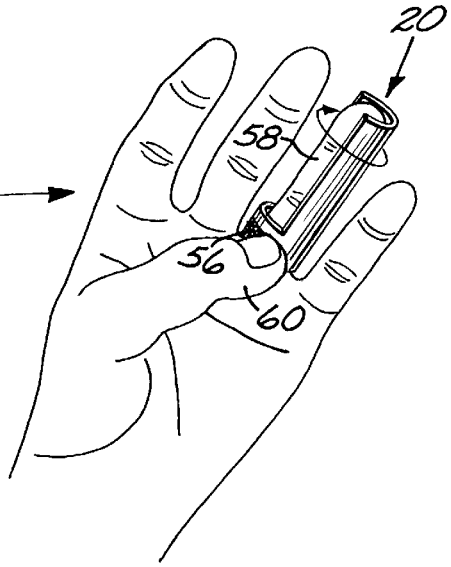

FIGS. 5A–5D illustrate the manner of using the slide system 20. The slide system is worn with the finger ring 22 on a finger 58 of the player, here illustrated as the ring finger of the left hand for a right-handed player. In FIG. 5A, the slide sleeve 24 is rotated to a position where it is not in use and is out of the way so that the finger may be used in conventional playing procedures not involving the use of the slide sleeve. To rotate the slide sleeve 24 to a position where it may be used as a slide, the user contacts the thumb 60 to the slide sleeve 24, typically the frictional engagement 56, as shown in FIG. 5B. The thumb 60 applies a force to the frictional engagement 56 to rotate the slide sleeve 24, see FIG. 5C. After sufficient rotation, the slide sleeve 24 is in the position shown in FIG. 5D, where it may be used as a slide during playing of the instrument. The steps of FIGS. 5A–5D are reversed to move the slide sleeve out of the way. Only the finger upon which the finger ring 22 is worn and the thumb of that hand are used in rotating the slide sleeve, leaving the other three fingers of that hand available for performing other functions.

The inventor has built prototypes of the slide system 20 and used them in the playing of a guitar. The prototypes are of the configuration illustrated in FIGS. 1–3 and 4A, as well as that of FIGS. 1–3 and 4B. The following dimensions of the prototypes are provided by way of illustration and not of limitation, and are not to be interpreted as limiting the scope of the invention. Referring to FIGS. 1A and 2A, $L_S$ is about 2.38 inches, $L_B$ is about 0.500 inches, and $L_R$ is about 0.350 inches. The inner diameter a of the finger ring 22 may be made in various values to accommodate different sizes of the fingers of players. The value of a is typically 11/16 inch, ¾ inch, 13/16 inch, or ⅞ inch, but larger or smaller ring sizes may be used. The following dimensions were used for all of the ring sizes: b=1.062 inches, c=0.935 inches, d=0.025 inches, e=0.070 inches, f=0.936 inches, g=0.926 inches. Comparing the values of c and f, the clearance at the bearing surface is about 0.001 inch. The width of the lip 36 was about 0.060–0.061 inches, and the width of the groove 50 was about 0.062–0.063 inches. Thus, the lip fits tightly into the groove with only 0.001–0.003 inches of tolerance, so that there is no chattering movement of the slide sleeve as the slide system is used and no associated undesired sounds produced. Some dimensions such as the wall thickness of the sleeve body 44 may be varied as desired to achieve particular sound quality during use of the slide.

The finger ring 22 and the slide sleeve 24 are preferably made of brass, and brass was used in the prototypes. The material of construction of the slide sleeve 24 in part determines the tone quality produced when the slide is used, and therefore other operable materials of construction such as glass, steel, and ceramics may be used as desired to achieve particular tone qualities. Generally, it is preferred that the finger ring 22 and the slide sleeve 24 be made of the same material, except that fragile materials such as glass are preferably not used in the finger ring 22. The present invention allows the player to use a single finger ring 22 and swap slide sleeves of different materials and/or different configurations onto the finger ring in some embodiments.

Figure 6:
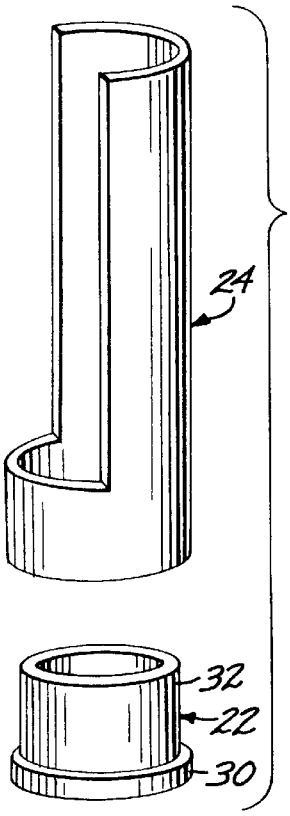
FIG. 6 is a perspective view of a second embodiment of the rotational engagement.
Figure 7:
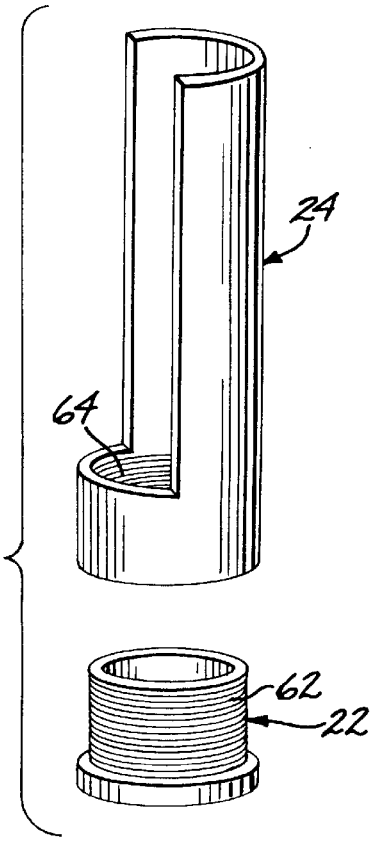
FIG. 7 is a perspective view of a third embodiment of the rotational engagement.

The approach of the invention includes various embodiments generally within the scope of the above disclosure. FIGS. 6 and 7 illustrate two other embodiments for the rotational engagement between the slide sleeve 24 and the finger ring 22. In the embodiment of FIG. 6, the relief and lip are not provided on the finger ring 22. The finger ring 22 has the flange 30 and the bearing surface 32, which extends the remainder of the length of the finger ring 22. In this embodiment, the entire bearing surface 32 serves as the first track for rotational movement, and the facing portion of the inner surface 52 of the slide sleeve base 40 serves as the second track. The slide sleeve 24 may be easily removed from the finger ring 22, allowing the swapping of different slide sleeves, if desired.

In the embodiment of FIG. 7, the outer surface of the finger ring 22 is threaded with threads 62, and matching threads 64 are provided on the inner surface 52 of the slide sleeve base 40. The threads 62 and 64 releasably lock the finger ring 22 and the slide sleeve 24 together. As the slide sleeve 24 is rotated on the threads 62 and 64, it moves axially according to the pitch of the threads.

Figure 10:
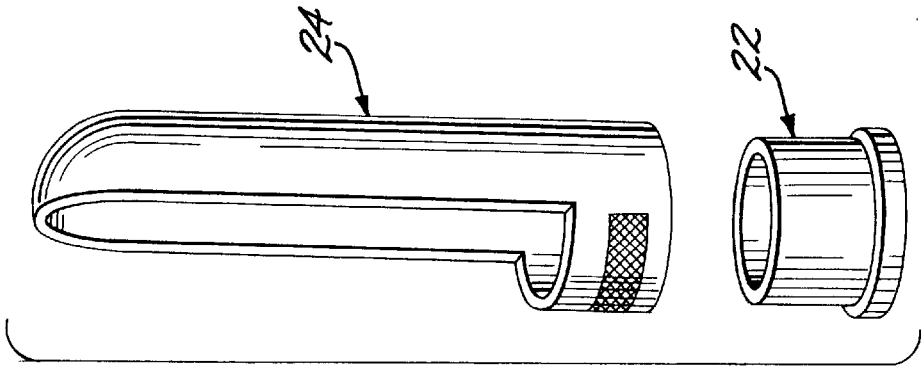
FIG. 10 is a perspective view of a fourth embodiment of the slide sleeve.
Figure 9:
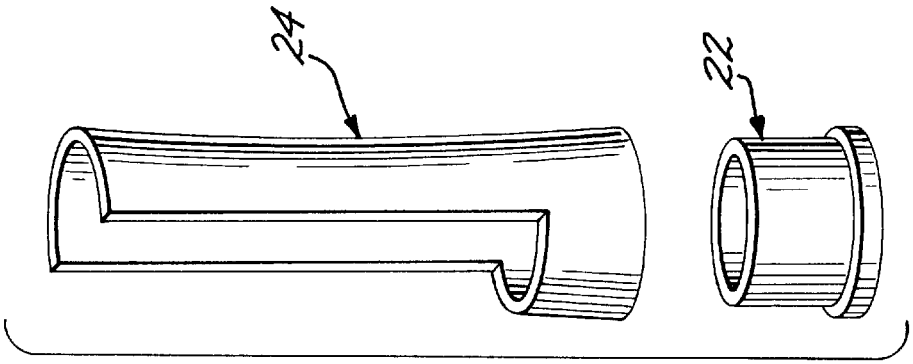
FIG. 9 is a perspective view of a third embodiment of the slide sleeve.
Figure 8:
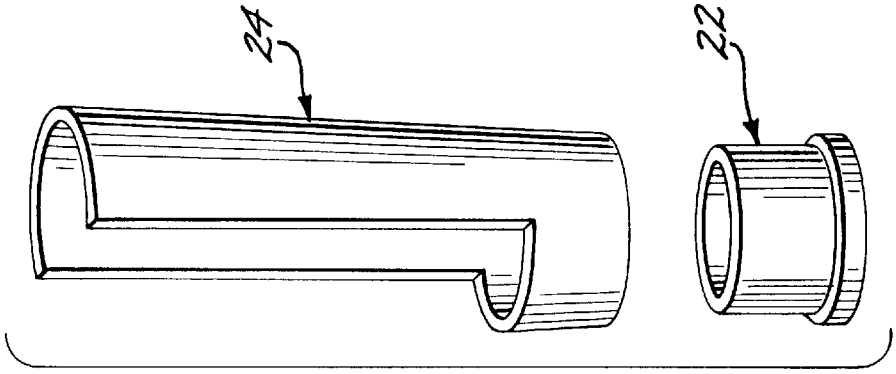
FIG. 8 is a perspective view of a second embodiment of the slide sleeve.

Various embodiments of the slide sleeve 24 may also be used. FIGS. 8–10 illustrate three other embodiments of the slide sleeve. In the embodiment of FIG. 8, the slide sleeve body 44 is tapered from a smaller size at the juncture with the slide sleeve base 40 to a larger size at locations remote from the slide sleeve base 40. In the embodiment of FIG. 9, the slide sleeve body 44 is radiused longitudinally along its length, producing a dished profile of the slide sleeve body 44. FIG. 10 shows a slide sleeve body 44 with a domed end. All of these variations of the basic tubular slide sleeve are within the scope of the invention and the terminology "semicylindrical" slide sleeve body.

The inventor has comparatively tested the prototypes of the present invention made as discussed above with the commercial embodiment of the slide bar described in U.S. Pat. No. 5,488,891. The slide bar of the '891 patent requires the user to cradle the slide bar between two fingers so that it may be pressed against the strings, an awkward positioning that leaves only two fingers available for other use such as string damping. The slide system of the present invention has no such limitation, and is fully operable with one finger and the thumb of the slide hand, leaving three fingers available for other uses such as string damping. Additionally, the inventor has observed that attempts to rotate the ring portion of a slide where the ring has a metal-to-skin contact and/or is split are generally quite unpredictable due to binding and friction, and because skin conditions may vary widely between dry and moist skin. The metal-to-metal bearing contact between the slide sleeve and the finger ring of the present invention avoids this problem, providing a low-friction, reproducible movement.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A stringed-instrument slide system, comprising:

a cylindrical finger ring having an inner diameter sized to be received on a finger of a human hand, the finger ring having a cylindrical finger ring axis;

a slide sleeve, comprising a cylindrical slide sleeve base overlying the finger ring and having a base axis coincident with the ring axis, and a semicylindrical slide sleeve body affixed to the slide sleeve base and having a body axis coincident with the base axis and the ring axis; and a rotational engagement, comprising a first cylindrical track extending generally circumferentially around an exterior of the finger ring, and a second cylindrical track extending generally circumferentially around an interior of the slide sleeve base, the second cylindrical track being slidably engaged to the first cylindrical track so that the slide sleeve may rotate on the finger ring about the finger ring axis.

2. The slide system of claim 1, further including a frictional engagement on an exterior surface of the slide sleeve base.

3. The slide system of claim 1, wherein the finger ring further includes:

a flange extending circumferentially around an outer surface thereof at one end of the outer surface.

4. The slide system of claim 1, wherein an inner diameter of the slide sleeve base is larger than an outer diameter of the finger ring by a clearance dimension of about 0.001 inch.

5. The slide system of claim 1, wherein the finger ring and the slide sleeve are made of brass.

6. The slide system of claim 1, wherein the finger ring further comprises:

at least one slit extending over at least a part of a length of the finger ring parallel to the cylindrical finger ring axis.

7. A stringed-instrument slide system, comprising:

a cylindrical finger ring having an inner diameter sized to be received on a finger of a human hand, the ring having a cylindrical finger ring axis;

a slide sleeve, comprising a cylindrical slide sleeve base having a base axis coincident with the ring axis, and a slide sleeve body extending from the slide sleeve base in a direction generally parallel to the base axis, the slide sleeve body comprising a tube having an opening therethrough extending generally parallel to the base axis; and means for engaging the slide sleeve to the finger ring and for permitting the slide sleeve to rotate about the cylindrical finger ring axis.

8. The slide system of claim 7, wherein the means for engaging and for permitting comprises:

a rotational engagement, comprising a first cylindrical track extending generally circumferentially around an exterior of the finger ring, and a second cylindrical track extending generally circumferentially around an interior of the slide sleeve base, the second cylindrical track being slidably engaged to the first cylindrical track.

9. The slide system of claim 7, wherein the opening extends circumferentially around the sleeve body for an angular distance of from about 45 degrees to about 315 degrees.

10. The slide system of claim 7, further including a frictional engagement on an exterior surface of the slide sleeve base.

11. A stringed-instrument slide system, comprising:

a cylindrical finger ring having an inner diameter sized to be received on a finger of a human hand, the ring having the form of a bushing with a cylindrical finger ring axis and comprising a flange having a radially enlarged diameter at a first end of the bushing, a cylindrical bearing surface adjacent to the flange, a relief section adjacent to the bearing surface having a radially reduced diameter, and a radially enlarged lip at a second end of the bushing;

a slide sleeve, comprising a cylindrical slide sleeve base overlying the finger ring and having a base axis coincident with the ring axis, a semicylindrical slide sleeve body affixed to the slide sleeve base and having a body axis coincident with the base axis and the ring axis; and a groove extending circumferentially around the slide sleeve at a location between the slide sleeve base and the slide sleeve body, the finger ring and the slide sleeve being dimensioned such that the lip of the finger ring is received into the groove of the slide sleeve and the sleeve base contacts and rides on the bearing surface when the slide sleeve is assembled over the finger ring, thereby releasably and rotationally engaging the slide sleeve to the finger ring.

12. The slide system of claim 11, further including at least one slot in the relief section and the lip of the finger ring, the at least one slot extending parallel to the finger ring axis.

13. The slide system of claim 11, further including a frictional engagement on an exterior surface of the slide sleeve base.

* * * * *